United States Patent [19]

Saino

[11] 4,217,731

[45] Aug. 19, 1980

[54] FIRE DOOR

[76] Inventor: Joseph N. Saino, 6560 Kirby Forest Cove, Memphis, Tenn. 38138

[21] Appl. No.: 37,858

[22] Filed: May 10, 1979

[51] Int. Cl.[2] ..... E05D 15/48

[52] U.S. Cl. ..... 49/169

[58] Field of Search ..... 49/169, 163, 170, 62, 49/177, 178, 179, 180; 160/180, 205, 116

[56] References Cited

U.S. PATENT DOCUMENTS

| | | | |
|---|---|---|---|
| 1,581,776 | 4/1926 | Altschul | 49/169 X |
| 2,739,645 | 3/1956 | Urquhart | 160/116 X |
| 2,759,227 | 8/1956 | Reid et al. | 49/169 X |
| 3,763,612 | 10/1973 | Saino | 52/806 X |

FOREIGN PATENT DOCUMENTS

| | | | |
|---|---|---|---|
| 89084 | 4/1957 | Norway | 160/180 |

*Primary Examiner*—Philip C. Kannan

[57] ABSTRACT

A combination slide-type fire door and hinge-type pass door for allowing personnel to exit through the pass door when the fire door is closed. The fire door is provided with an opening therethrough substantially the same size and shape as the pass door. One side edge of the pass door is hinged to the fire door adjacent one side edge of the opening through the fire door whereby the pass door can be moved between a closed position in which exit through the opening is prevented and an opened position in which exit through the opening is allowed. A peg member and a latch member are attached to the other side of the pass door. The peg member has a distal end spaced outwardly from the side edge of the pass door and arranged substantially perpendicular to the face surface of the pass door. The fire door has an aperture for receiving the distal end portion of the peg member when the pass door is closed. The fire door has a cavity for receiving a portion of the latch member when the pass door is closed. The opening through the fire door extends through the bottom edge of the fire door so that personnel can pass through the opening without having to step over any portion of the fire door.

8 Claims, 6 Drawing Figures

FIRE DOOR

BACKGROUND OF THE INVENTION

1. Field of the Invention

This invention relates in general to movable doors and more specifically to fire doors.

2. Description of the Prior Art

Heretofore, various fire doors have been developed. See, for example, Knopf, U.S. Pat. No. 1,112,071, and Saino, U.S. Pat. No. 3,763,612. None of the above patents disclose or suggest the present invention.

The National Fire Protection Association, in Pamphlet 80, defines a labeled fire door assembly as "a combination of a fire door, hardware and other accessories which together provide a specific degree of protection to an opening and to which has been attached a label, symbol or other identifying mark of a nationally recognized testing laboratory, inspection agency, or other organization concerned with product evaluation, that maintains periodic inspection of production of labeled equipment or materials, and by whose labeling is indicated compliance with nationally recognized standards or tests to determine suitable uses in a specified manner." One problem with such labeled fire door assemblies is that for egress purposes various building codes and the like require any building having a slide-type fire door to also have a hinged-type personnel door. The normal practice in the past has been to provide a hinged-type personnel door in the wall of the building adjacent a slide-type fire door.

The following patents relate in general to the present invention: Neller, U.S. Pat. No. 1,184,983; Norton, U.S. Pat. No. 1,266,980; Ferris, U.S. Pat. No. 1,288,861; Graves, U.S. Pat. No. 1,506,925; Urquhart, U.S. Pat. No. 2,739,645; Carlo, U.S. Pat. No. 3,090,424; Szwartz, U.S. Pat. No. 4,081,018. None of the above patents disclose or suggest the present invention.

SUMMARY OF THE INVENTION

The present invention is directed towards providing an improved fire door. The concept of the present invention is to combine a fire door with a hinged pass door whereby personnel can exit through the pass door when the fire door is closed.

The fire door of the present invention includes, in general, a fire resistant panel member for substantially covering an opening in a wall, the panel member having a pass opening therethrough; a fire resistant pass door member for substantially covering the pass opening, the pass door member having a first edge and a second edge; hinge means for attaching the first side edge of the pass door member to the first side edge of the pass opening to allow the pass door member to move between a closed position and an opened position; peg means attached to the second edge of the pass door member with the distal end of the peg means arranged substantially perpendicular to the pass door member for engaging the panel member when the pass door member is in the closed position to prevent separation of the second edges of the pass door member and panel member in a plane parallel to the faces thereof; and a latch means for engaging the panel member when the pass door member is in the closed position to prevent the pass door member from inadvertently swinging open.

DESCRIPTION OF THE PREFERRED EMBODIMENT

Figure 1:
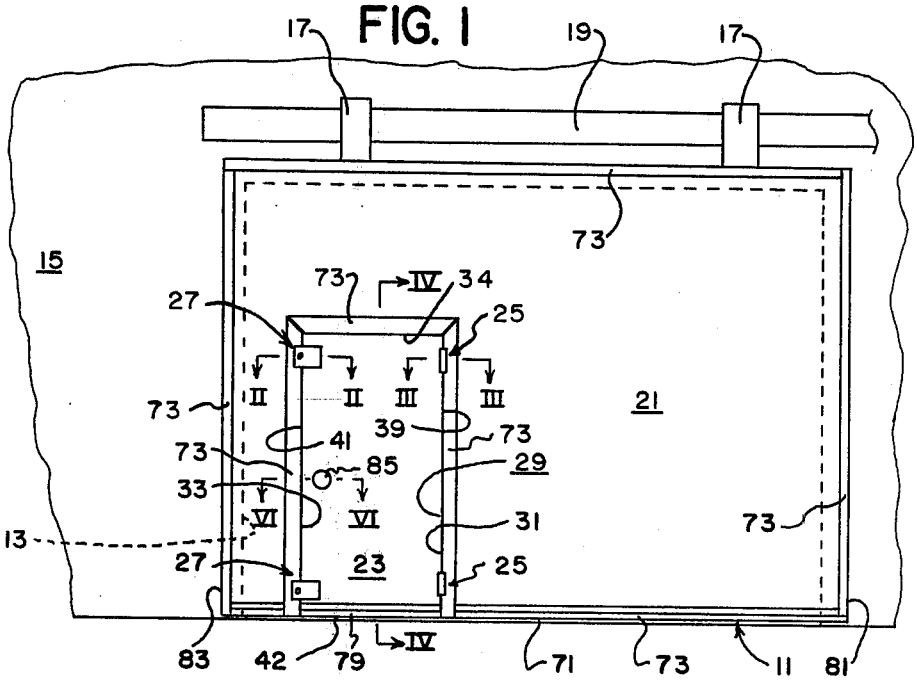
FIG. 1 is a front elevational view of the fire door of the present invention shown mounted to a wall.

The fire door 11 of the present invention is for selectively blocking an opening 13 through a wall 15 in a manner and for reasons which will be apparent to those skilled in the art. The fire door 11 is coupled to the wall 15 in any manner which allows the door 11 to be moved between an opened position in which the opening 13 is substantially unobstructed and a closed position in which the opening 13 is substantially blocked. For example, the fire door 11 may be slidably attached to the wall 15 in the same manner as disclosed in U.S. Pat. No. 3,763,612. More specifically, a plurality of bolster members 17 may be fixedly attached to the top of the fire door 11 for slidably engaging a rail member 19 which is fixedly attached to the wall 15 above the opening 13. The fire door 11 includes, in general, a fire resistant panel member 21, a fire resistant pass door member 23, hinge means 25, and a retainer means.

The panel member 21 has a pass opening 29 therethrough. The pass opening 29 is substantially the same shape and size as the pass door member 23 and has a first side edge 31 and a second side edge 33 and a top edge 34. The panel member 21 is substantially the same shape as the opening 13 and is preferably somewhat larger than the opening 13 so that when the fire door is in the closed position as shown in FIG. 1, the panel member 21 overlaps portions of the opening 13 as shown in FIG. 1. The panel member 21 has a face surface 35 and a back surface 37. The specific construction of the panel member 21 may vary. For example, the panel member 21 may be constructed according to the teachings of U.S. Pat. No. 3,763,612.

The pass door member 23 is preferably substantially the same size and shape as the pass opening 29. The pass door member 23 has a first side edge 39, a second side edge 41, a bottom edge 42, a face surface 43, and back surface 45. The specific construction of the pass door member 23 may vary as will be apparent to those skilled in the art. The pass door member 23 is preferably constructed in a manner commonly used in the fire door construction industry and as will be well known to those skilled in the art.

Figure 2:
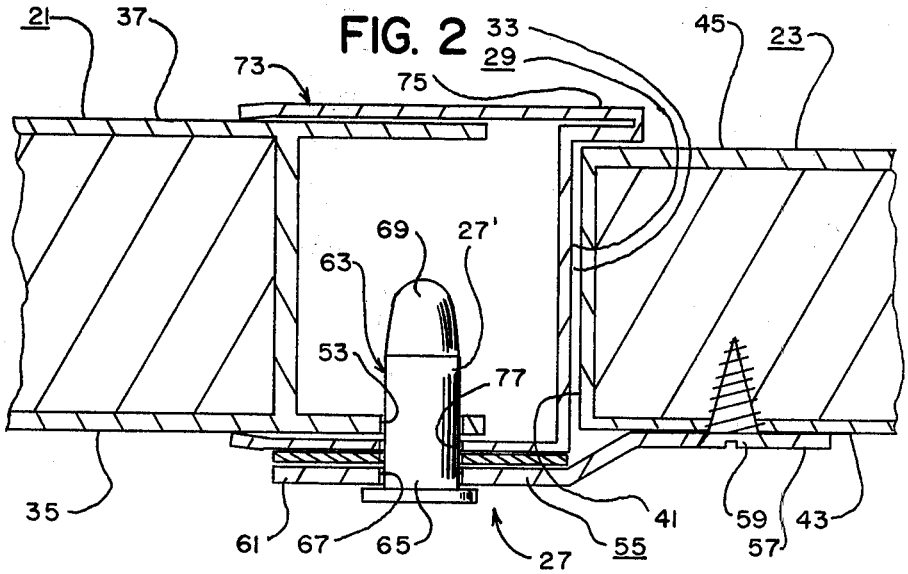
FIG. 2 is a sectional view as taken on line II—II of FIG. 1.
Figure 3:
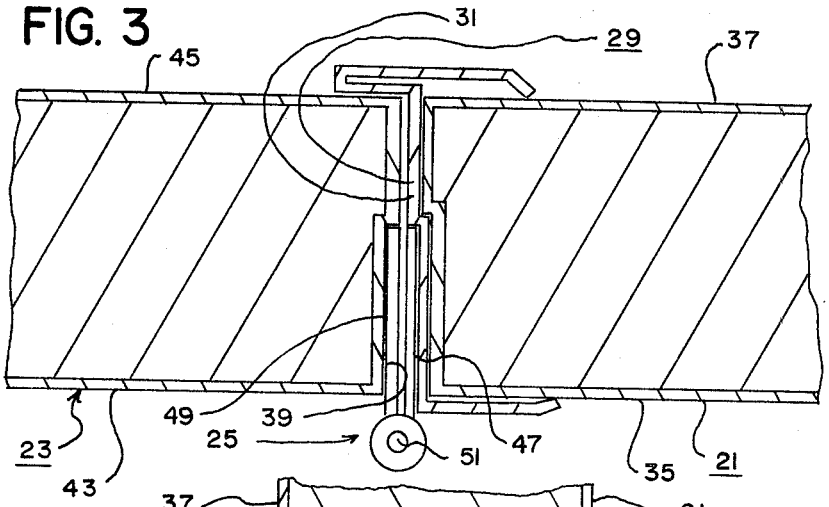
FIG. 3 is a sectional view as taken on line III—III of FIG. 1.
Figure 5:
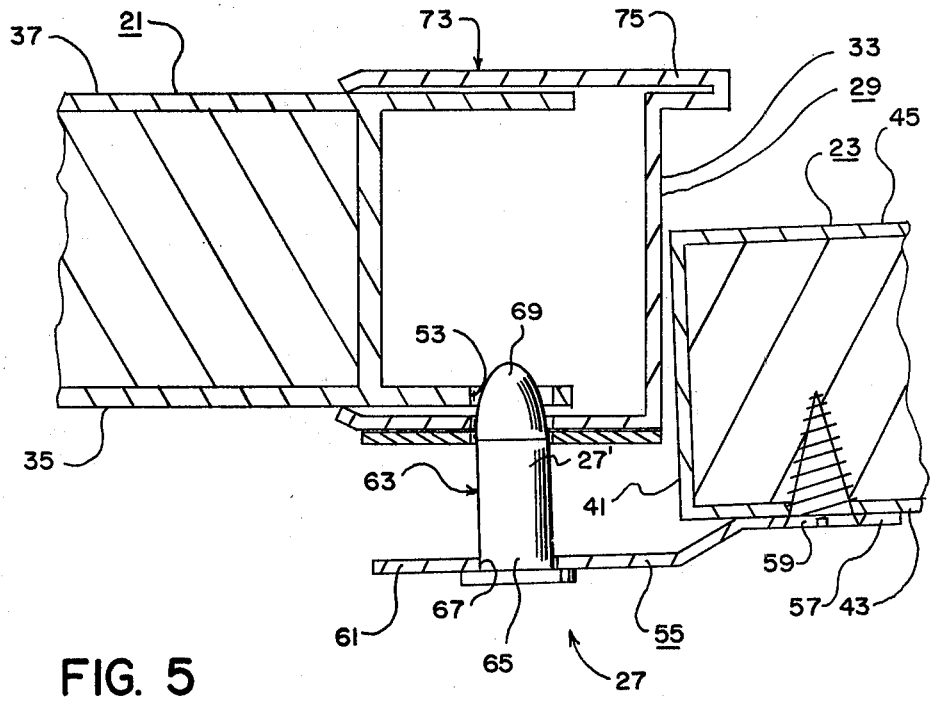
FIG. 5 is a sectional view similar to FIG. 2 but with portions thereof shown in a moved position.

The hinge means 25 attach the first side edge 39 of the pass door member 23 to the first side edge 31 of the pass opening 29 of the panel member 21 for allowing the pass door member 23 to pivot between a closed position in which the pass opening 29 is substantially covered by the pass door member 23 (see FIG. 2) and an opened position in which the pass opening 29 is substantially unobstructed by the pass door member 23 (see FIG. 5). The hinge means 25 may be of any construction apparent to those skilled in the art. For example, the hinge means 25 may include a first plate member 47 fixedly attached to the first side edge 31 of the pass opening 29 of the panel member 21 in any manner apparent to those skilled in the art such as by way of screws or the like (not shown), a second plate member 49 fixedly attached to the first side edge 39 of the pass door member 23 in any manner apparent to those skilled in the art such as by way of screws or the like (not shown), and a pin member 51 pivotally attaching the first and second plate members 47, 49 to one another (see FIG. 3).

The retainer means preferably includes a peg means 27. The peg means 27 is attached to the second side edge 41 of the pass door member 23 and acts as a retainer to prevent any substantial movement of the second side edge 41 of the pass door member 23 from the second side edge 33 of the pass opening 29 in a plane parallel to the face surfaces 35, 43 when the pass door member 23 is in the closed position. The peg means 27 includes a distal end 27′ arranged substantially perpendicular to the face surface 43 of the pass door member 23 for engaging the panel member 21 when the pass door member 23 is in the closed position (see FIG. 2). The panel member 21 preferably has an aperture 53 in the face surface 35 thereof for receiving the distal end 27′ of the peg means 27 when the pass door member 23 is in the closed position. The peg means 27 preferably includes an arm-like member 55 having a first end fixedly attached to the face surface 43 of the pass door member 23 in any manner apparent to those skilled in the art such a by way of a screw 59 and having a second end 61 extending outward of the second side edge 41 of the pass door member 23. The distal end 27′ of the peg means 27 may consist of a peg member 63 fixedly attached to the second end 61 of the arm-like member 55 and extending in a direction perpendicular to the face surface 43 of the pass door member 23. The peg member 63 preferably has a first end 65 fixedly attached to the second end 61 of the arm-like member 55 in any manner apparent to those skilled in the art, such as by being welded about an aperture 67 in the second end 61 of the arm-like member 55, and a second end 69 for extending into the aperture 53 when the pass door member 23 is in the closed position. The second end 69 of the peg member 63 is preferably somewhat tapered for allowing it to easily pass into the aperture 53 when the pass door member 23 is moved between the opened and closed positions. The fire door 11 may include two substantially identical peg means 27 located as shown in FIG. 1.

The panel member 21 has a bottom edge 71 and the pass opening 29 preferably extends through the bottom edge 71 of the panel member 21 so that personnel can pass through the pass opening 29 when the pass door member 23 is in the opened position without being required to step over any portion of the panel member 21, whereby the safety of the fire door 11 is enhanced. That is, if the opening 29 did not extend through the bottom edge 71 of the panel member 21 so that personnel would have to step over a portion of the panel member 21 in order to pass through the opening 29, such personnel could, for example, trip over such portion of the panel member 21 especially if such personnel was in a hurry due to a fire or the like within the confines of the wall 15.

The fire door 11 preferably includes a frame means 73 for extending about the first side edge 31, second side edge 33 and top edge 34 of the pass opening 29. The frame means 73 may extend around the entire periphery of the panel member 21 (see FIG. 1). The frame means 73 may be of any construction apparent to those skilled in the art and may be fixedly attached to the panel member 21 in any manner apparent to those skilled in the art, such as by way of screws or the like (not shown). The portion of the frame means 73 across the bottom edge 71 of the panel member 21 may act as a guide roller channel as will be apparent to those skilled in the art. The frame means 73 that is attached to the second side edge 33 of the pass opening 29 preferably includes an offset portion 75 for acting as a stop for the pass door member 23 when the pass door member 23 is in the closed position (see FIGS. 2 and 5). The frame means 73 has an aperture 77 for alignment with the aperture 53 and for receiving the peg member 63 when the pass door member 23 is in the closed position (see FIGS. 2 and 5).

Figure 4:
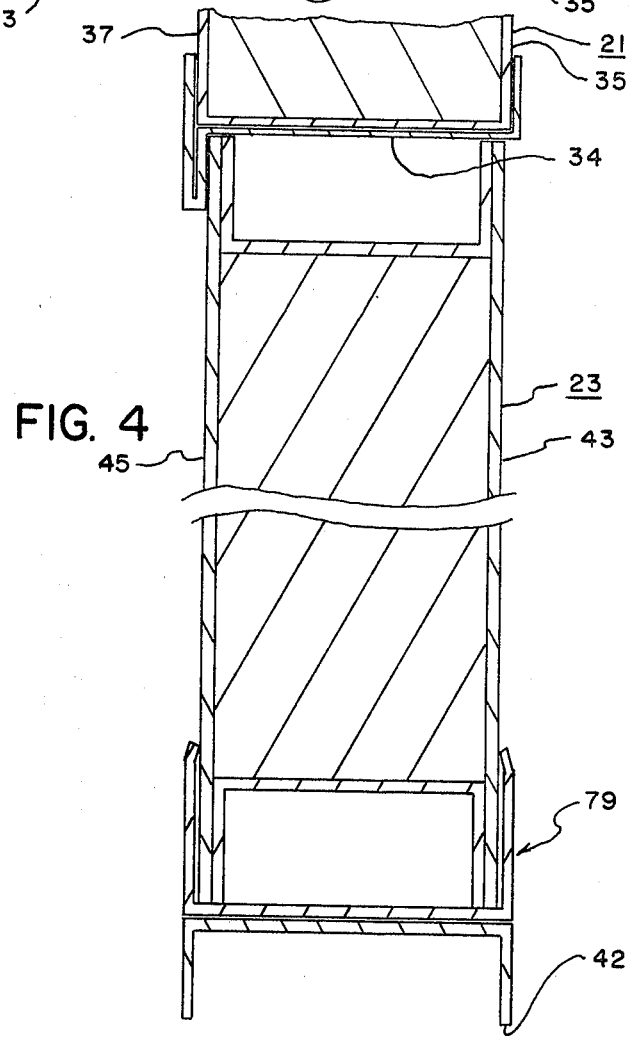
FIG. 4 is a sectional view as taken on line IV—IV of FIG. 1.

The pass door member 23 preferably includes a frame means 79 across the bottom edge 42 thereof (see, for example, FIG. 4). The frame means 79 may be of any construction apparent to those skilled in the art and may act as a guide roller channel as will be apparent to those skilled in the art. The frame means 79 may be attached to the pass door member 23 in any manner apparent to those skilled in the art, such as by way of screws or the like (not shown).

The panel member 21 has a first side edge 81 and a second side edge 83. The second side edge 33 of the pass opening 29 is preferably located substantially adjacent the second side edge 83 of the panel member 21. By so locating the pass opening 29, the pass door member 23 will be subject to the least amount of buckling forces, etc., in the event of a fire within the wall 15, since the portions of the panel member 21 closest to the wall 15 will be subjected to the least amount of deformation while the middle portion of the panel member 21 will be subjected to the greatest amount of deformation as will be apparent to those skilled in the art.

Figure 6:
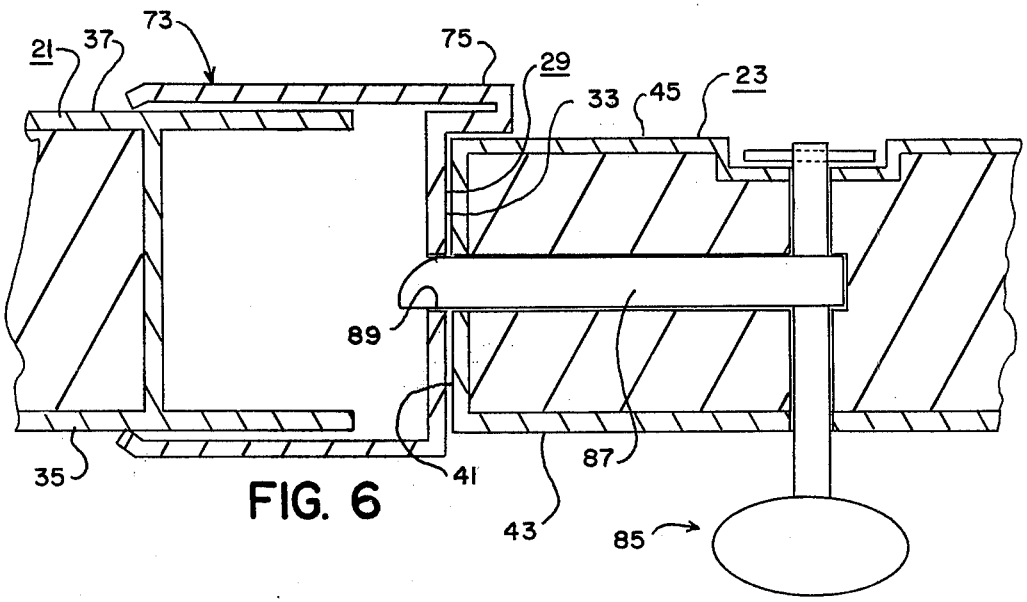
FIG. 6 is a sectional view as taken on line VI—VI of FIG. 1.

The retainer means preferably includes a latch means engaging the panel member 21 when the pass door member 23 is in the closed position to any substantial swinging movement of the second side edge 41 of the pass door member 23 from the second side edge 33 of the pass opening 29 when the pass door member 23 is in the closed position. The latch means preferably includes a substantially typical door knob assembly 85 for allowing the pass door member 23 to be opened from a closed position and to be substantially latched in the closed position. It should be noted that to insure proper sliding movement of the panel member 21, it might be desired to construct the door knob assembly 85 in any manner apparent to those skilled in the art, so that at least the portion thereof adjacent the back surface 45 of the pass door member 23 does not extend a great amount rearward of the back surface 45 thereof. For example, the door knob assembly 85 may be constructed so that the door knob (not shown) thereof adjacent the back surface of the pass door member 23 can fold to a low profile position when not in use in any manner which should now be apparent to those skilled in the art. The door knob assembly 85 includes a standard latch member 87 for extending into a cavity 89 provided in the second side edge 33 of the pass opening 29, extending into the frame means 73 (see FIG. 6).

Although the present invention has been described and illustrated with respect to a preferred embodiment thereof, it is not to be so limited since changes and modifications may be made therein which are within the full intended scope of the present invention.

I claim:

1. A fire door for selectively blocking an opening in a wall, said fire door comprising: a fire resistant panel member for substantially covering said opening in said wall, said panel member having a pass opening therethrough, said panel member having a face surface, said pass opening having a first side edge and a second side edge; a fire resistant pass door member for substantially covering said pass opening, said pass door member having a face surface and a first side edge and a second side edge; hinge means for attaching said first side edge of said pass door member to said first side edge of said pass opening of said panel member and for allowing said pass door member to move between a closed position in which said pass opening is substantially covered by said pass door member and an opened position; peg means for being attached to said second side edge of said pass door member, said peg means including a distal end arranged substantially perpendicular to said face surface of said pass door member for engaging said panel member when said pass door member is in said closed position; and latch means for engaging said panel member when said pass door member is in said closed position.

2. The fire door of claim 1 in which said panel member has an aperture in said face surface thereof for receiving said distal end of said peg means when said pass door member is in said closed position.

3. The fire door of claim 2 in which said panel member has a first side edge and a second side edge, and in which said second side edge of said pass opening is located substantially adjacent said second side edge of said panel member.

4. The fire door of claim 2 in which said panel member has a bottom edge, and in which said pass opening extends through said bottom edge of said panel member.

5. An improved fire door of the type including a substantially fire resistant panel member attached to a wall for movement between a closed position in which an opening through said wall is substantially covered by said panel member and an opened position in which said opening through said wall is uncovered, wherein the improvement comprises: a substantially fire resistant pass door member having a face surface and having a first side edge and a second side edge; said panel member having an opening therethrough substantially the same size and shape as said face surface of said pass door member, said opening through said panel member having a first side edge and a second side edge; hinge means for pivotally attaching said first side edge of said pass door member to said panel member adjacent said first side edge of said opening through said panel member and for allowing said pass door member to move between a closed position in which said opening through said panel member is substantially covered by said pass door member and an opened position in which said opening through said panel member is uncovered; and retainer means for preventing any substantial movement of said second side edge of said pass door member from said second side edge of said opening through said panel member when said pass door member is in said closed position, said retainer means including a peg member attached to said pass door member, said peg member having a distal end portion arranged substantially perpendicular to said face surface of said pass door member, said panel member having an aperture therein for receiving said distal end portion of said peg member when said pass door member is in said closed position, said retainer means including a latch means for engaging said panel member when said pass door member is in said closed position.

6. The improvement of claim 5 in which said panel member has a first side edge and a second side edge, and in which said second side edge of said opening through said panel member is located substantially adjacent said second side edge of said panel member.

7. The improvement of claim 5 in which said panel member has a bottom edge, and in which said opening through said panel member extends through said bottom edge of said panel member.

8. The improvement of claim 5 in which said retainer means includes a second peg member attached to said pass door member, said second peg member of said retainer means having a distal end portion arranged substantially perpendicular to said face surface of said pass door member, said panel member having a second aperture therein for receiving said distal end portion of said second peg member of said retainer means when said pass door member is in said closed position.

* * * * *